US006381770B1

(12) United States Patent
Raisch

(10) Patent No.: US 6,381,770 B1
(45) Date of Patent: May 7, 2002

(54) EXTENDABLE BATHTUB SPOUT

(76) Inventor: Kevin Norman Raisch, 3977 Ludwig, Oxford, MI (US) 48371

( * ) Notice: Subject to any disclaimer, the term of this patent is extended or adjusted under 35 U.S.C. 154(b) by 0 days.

(21) Appl. No.: 09/792,824

(22) Filed: Feb. 23, 2001

(51) Int. Cl.[7] ..... A47K 3/20
(52) U.S. Cl. ..... 4/570; 4/567; 4/678
(58) Field of Search ..... 4/567, 568, 570, 4/677, 678; 239/195, 197; 137/801

(56) References Cited

U.S. PATENT DOCUMENTS

| | | | | |
|---|---|---|---|---|
| 2,997,722 A | * | 8/1961 | Pearson | 4/570 |
| 4,827,538 A | * | 5/1989 | Heimann et al. | 4/677 |
| 5,073,991 A | | 12/1991 | Marty | |
| 5,093,942 A | | 3/1992 | Lang | |
| 5,758,690 A | | 6/1998 | Humpert et al. | |
| 5,822,811 A | | 10/1998 | Ko | |
| 5,934,325 A | | 8/1999 | Brattoli et al. | |

* cited by examiner

*Primary Examiner*—Robert M. Fetsuga
(74) *Attorney, Agent, or Firm*—John M. Naber

(57) ABSTRACT

The invention is an extensible and retractable bathtub spout. The spout has a stationary base with a means to attach the stationary base to a structure, a detachable pull-out spout unit having a releasable mount to a front opening of the stationary base, a pressurized water supply, and a length of extensible hose attached to water supply and the pull-out spout unit. The extensible hose is contained in a stored position behind the rear opening of the stationary base and capable of being extended outwardly. The pull-out spout unit can also have a diverter valve and diverter controller, to divert pressurized water to a showerhead whether the pull-out spout unit is in the extended or retracted position. The pull-out spout unit can also have a backflow preventer. The extensible hose can have a means to prevent over-extension of the extensible hose. In configurations where a showerhead is not present, an optional second stationary base can be mounted at a showerhead level and function as a showerhead as desired when the pull-out spout is extended and mounted therein.

7 Claims, 3 Drawing Sheets

EXTENDABLE BATHTUB SPOUT

BACKGROUND OF THE INVENTION

1. Field of the Invention

The present invention relates generally to bathtub fixtures, and specifically to an extendable bathtub spout.

2. Discussion of the Prior Art

Hand-held extendable water faucets or spouts are known in the prior art for sinks and even spas. See generally, U.S. Pat. Nos. 5,822,811; 5,758,690; 5,073,991; and 5,093,942. Such prior art devices are relatively expensive and complex compared to conventional faucets. The spout normally rests in a base and can be pulled from the base when the user wishes to divert the flow of water beyond the range of a typical fixed faucet.

There is a need to develop an extendable spout for bathtubs. Such a device can adapt to a plumbing configuration that contains both a spout and a showerhead using a diverter well known in the prior art. Further, such a device would be very useful for applications where a sink (even with an extendable faucet) or an extendable showerhead are inadequate. For example, an extendable bathtub spout could assist in the bathing of children or large pets. Further, disabled bathers could benefit from such a device. Such a device could also simplify installations where the spout can be extended and attached at showerhead level, eliminating the need to install a separate showerhead. Unfortunately, an extendable bathtub spout is unknown in the prior art.

SUMMARY OF THE INVENTION

Accordingly, an object of the present invention is to provide an extensible and retractable bathtub spout.

It is a further object of the present invention to provide a bathtub spout having a stationary base with a hollow bore, a pull-out spout unit that can reciprocally connect to the stationary base, a length of flexible hose connected to the pressurized water supply slidably passing through the hollow bore of the stationary base and an outer end attaching to a pull-out spout unit.

It is a further object of the present invention to provide an extensible and retractable bathtub spout having a diverter valve and diverter controller within the pull-out spout unit, whereby the pressurized water supply can be diverted to an optional showerhead whether the pull-out spout unit is in the extended or retracted position.

It is a further object of the present invention to allow various means to releasably attach the stationary base and the pull-out spout unit such as a flexible tab mechanism or a threaded mount.

It is a further object of the present invention to provide a means to prevent over-extension of the flexible hose.

It is a further object of the present invention to provide an extensible and retractable bathtub spout with a backflow preventer.

It is a further object of the present invention to provide an extensible and retractable bathtub spout adapted to extend and remount at showerhead level thereby eliminating the need to provide a separate showerhead installation.

The present invention can best be understood through the following description and accompanying figures.

BRIEF DESCRIPTION OF THE FIGURES

The above and other objects, features, and advantages will become more readily apparent from the following description, reference to the accompanying figures in which.

DETAILED DESCRIPTION OF THE PREFERRED EMBODIMENT

Figure 1:
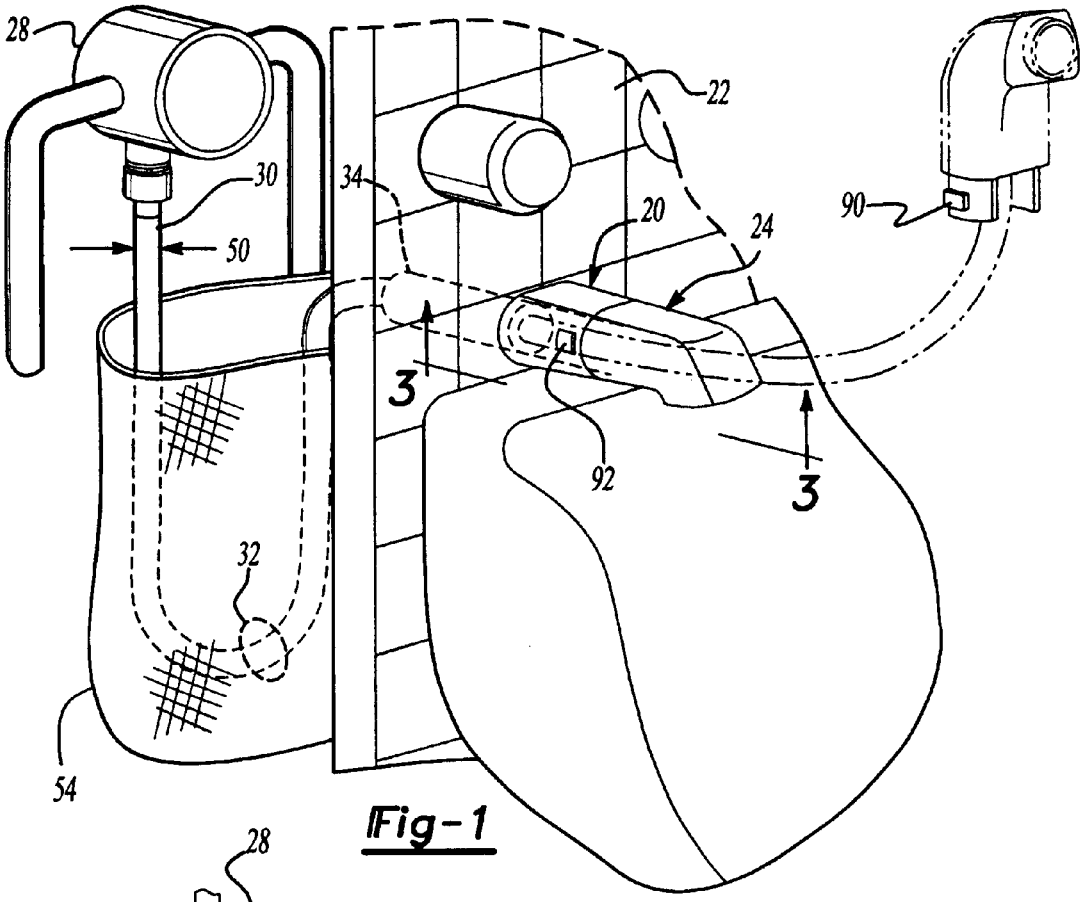
FIG. 1 illustrates a perspective view of the bathtub spout device according to the preferred embodiment.
Figure 2:
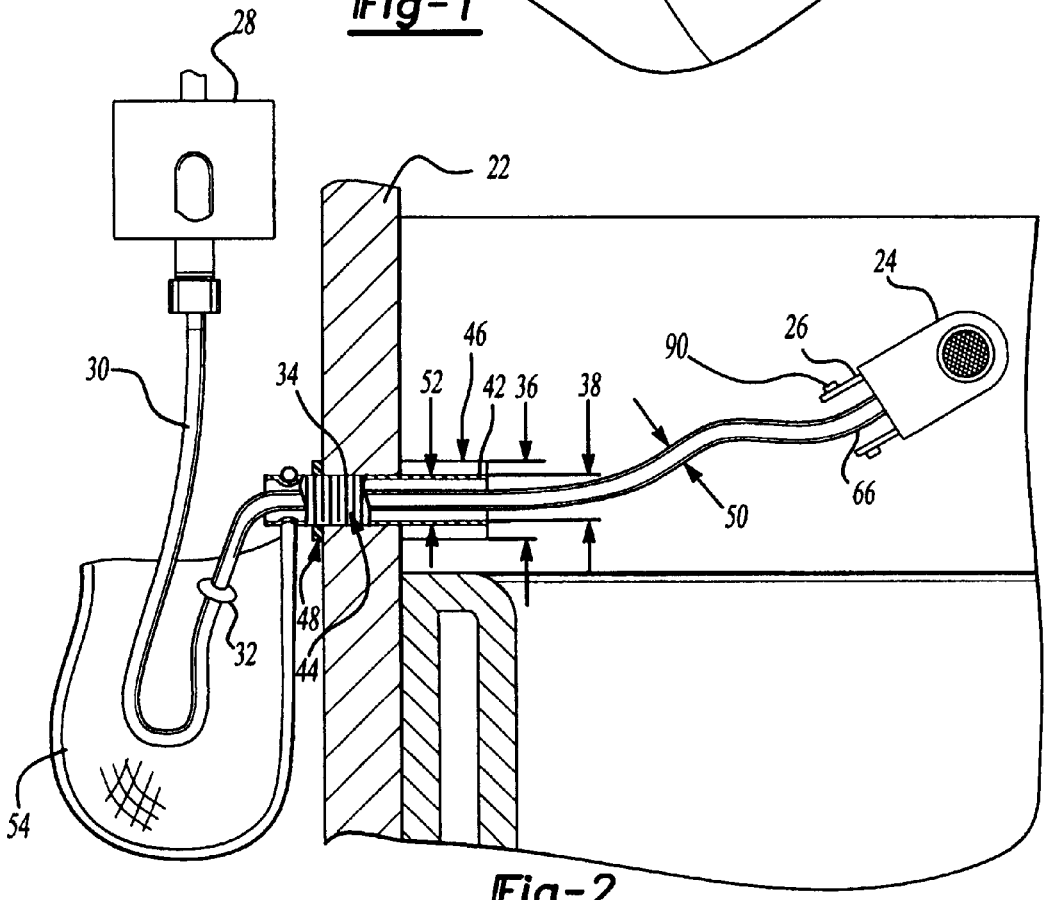
FIG. 2 illustrates a side view of the preferred embodiment with the spout extended.

The present invention generally relates to an extendable bathtub spout. Several possible configurations of the present invention are possible. One possible configuration illustrated in FIG. 1 shows a perspective view of the preferred embodiment. FIG. 2 illustrates a side view of this embodiment with a detachable spout in an extended position.

Specifically, the preferred embodiment includes a stationary base 20 having a base housing 46 with a base housing external diameter 36. Extending from and attached to the base housing 46 is an externally threaded hollow sleeve 34 having an external diameter 38 that allows extension through a hole in a structure such as a wall 22 having a wall front side and a wall back side. The threaded hollow sleeve 34 also has a sleeve front opening 42 and a sleeve rear opening 44.

The stationary base housing external diameter 36 is greater than the diameter of the hole in the wall 22. The externally threaded hollow sleeve 34 attaches on the back side of the wall 22 using a threaded nut 48. This configuration securely attaches the stationary base 20 to the wall 22.

The preferred embodiment also has an extensible hose 30 that attaches to a hot/cold-pressurized water supply 28. Controls for the pressurized water are well known in the prior art and are not shown. The present invention can also be easily adapted to include a backflow preventer (not shown) and a diverter(shown in FIGS. 4 and 5) that are also well known in the prior art. The backflow preventer could be attached at any point beyond the hot/cold-pressured water supply 28.

The extensible hose 30 has a diameter 50 that is smaller than an internal threaded hollow sleeve diameter 52 and an extensible hose distal end 66.

Releasably mounted to the stationary base 20 is a pull-out spout unit 24. For illustrative purposes only, the pull-out spout unit 24 attaches to the front opening of the stationary base 20 by a releasable mount such as a pair of flexible tabs 26 shown FIGS. 2 and 6. The flexible tabs 26 have a raised portion 90 to engage and secure within a pair of matching openings 92 on the stationary base 20. Other releasable mounts, such as threaded mounts, machined threads, pins, friction, tabs, or clips are also possible.

The extensible hose 30 extends from the hot/cold pressurized water supply 28 through the hollow sleeve rear opening 44 and out the hollow sleeve front opening 42 where the extensible hose distal end 66 attaches to the pull-out spout unit 24. When released, the pull-out spout unit 24 can extend the length of the extensible hose 30. In the preferred embodiment, the extensible hose 30 also has an optional hose stop 32 to prevent the over extension of the extensible hose 30 and to limit extension of the pull-out spout unit 24. While the pull-out spout unit 24 is attached to the stationary base 20, the extensible hose 30 can be in a stored position being contained behind the rear opening of the stationary base 20 within an optional hose protection bag 54 shown in FIGS. 2 and 3.

Figure 3:
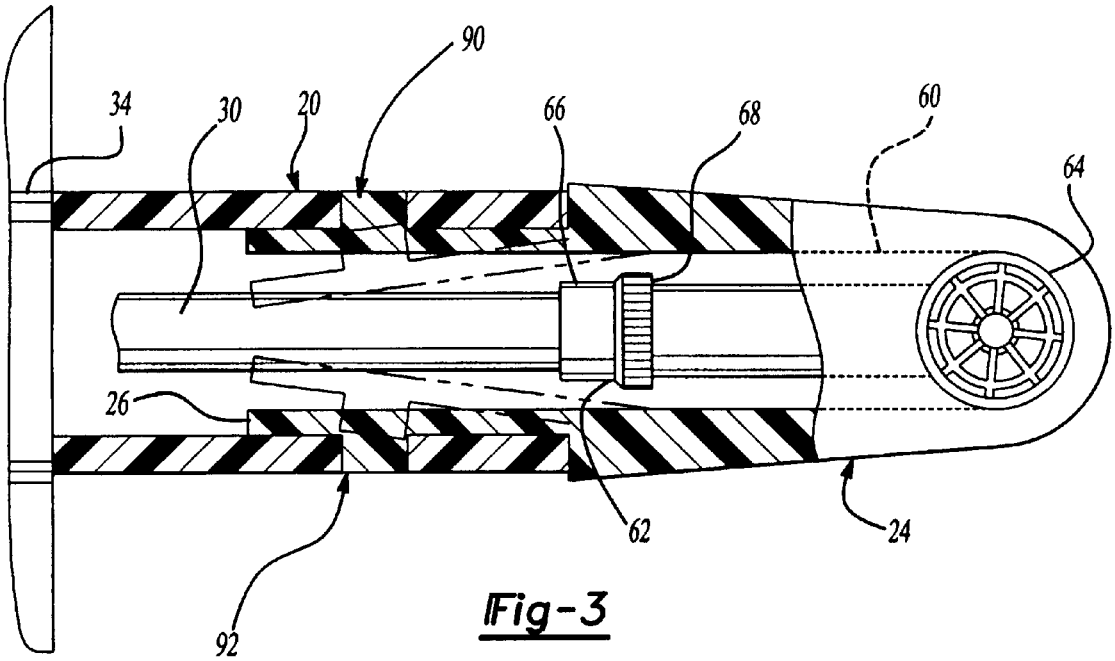
FIG. 3 is horizontal cross section of the preferred embodiment as indicated in FIG. 1.

FIG. 3 shows more detail of the pull-out spout unit 24 of the first embodiment having a hollow bore 60 with an inner open end 62 and an outer open end 64. The inner open end 62 receives the extensible hose distal end 66 by a connector 68 (such as threaded means, friction, clamps and the like), the outer open end 64 having a spout to direct flow of pressurized water.

Figure 4:
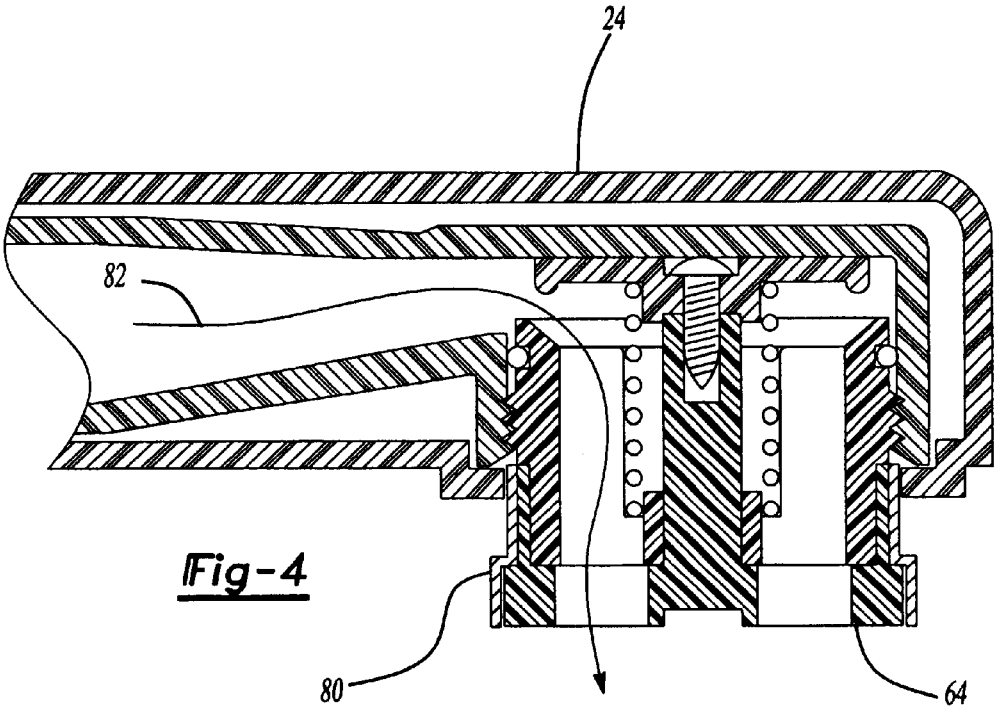
FIG. 4 illustrates a cross section of the preferred embodiment of the spout showing a showerhead diverter valve and controller with the water directed out the spout.
Figure 5:
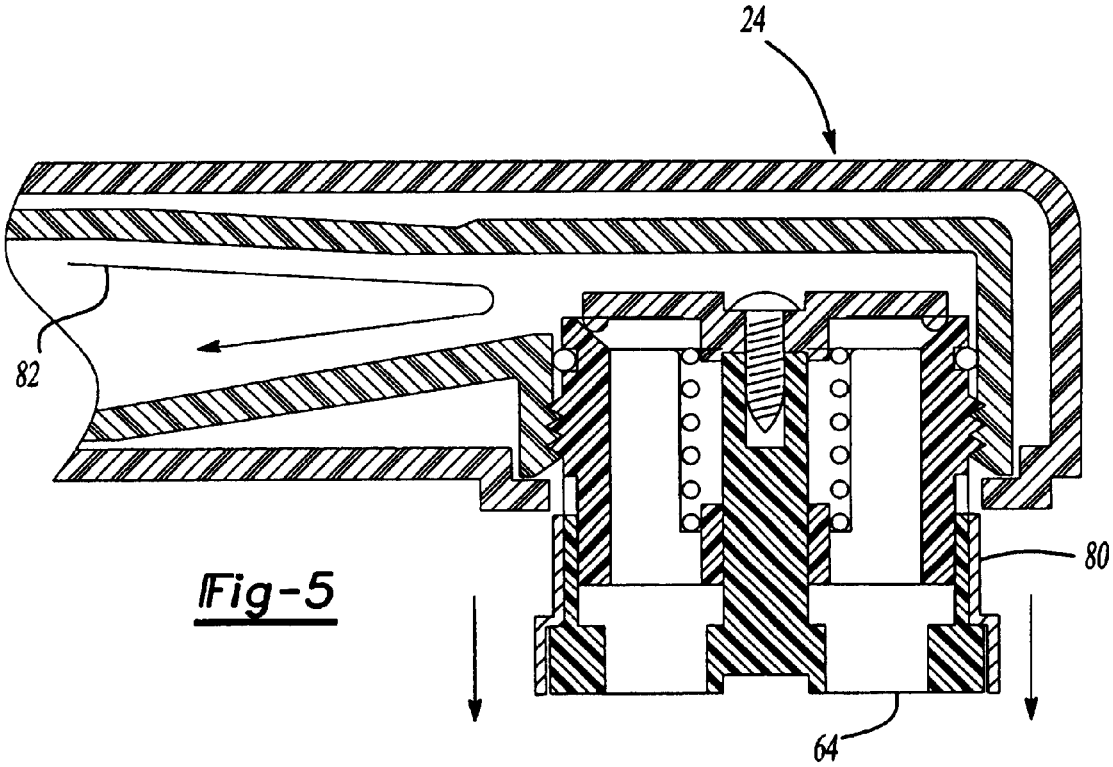
FIG. 5 illustrates a cross section of the preferred embodiment of the spout showing a showerhead diverter valve and controller with the water diverted to the showerhead.

FIG. 4 shows more detail of the pull-out spout unit 24 to an optional showerhead diverter valve that can be used in configurations where an optional showerhead is attached (not shown). A diverter controller 80 in its normal position shown in FIG. 4 allows the flow of water to pass out the outer open end 64 as demonstrated by a water flow line 82. FIG. 5 shows the diverter controller 80 in its diverted position after the outer open end 64 has been pulled down as indicated by arrows. In the diverted position, the flow of water is diverted to the showerhead as demonstrated by the water flow line 82. The diverter controller 80 for this embodiment is well known in the prior art and can be obtained from Delta Faucet Company of 55 East $111^{th}$ Street, Indianapolis, Ind. 46280. The unique feature of the present invention allows the pressurized water to be diverted to the showerhead whether the pull-out spout unit 24 is its extended or retracted position.

Figure 6:
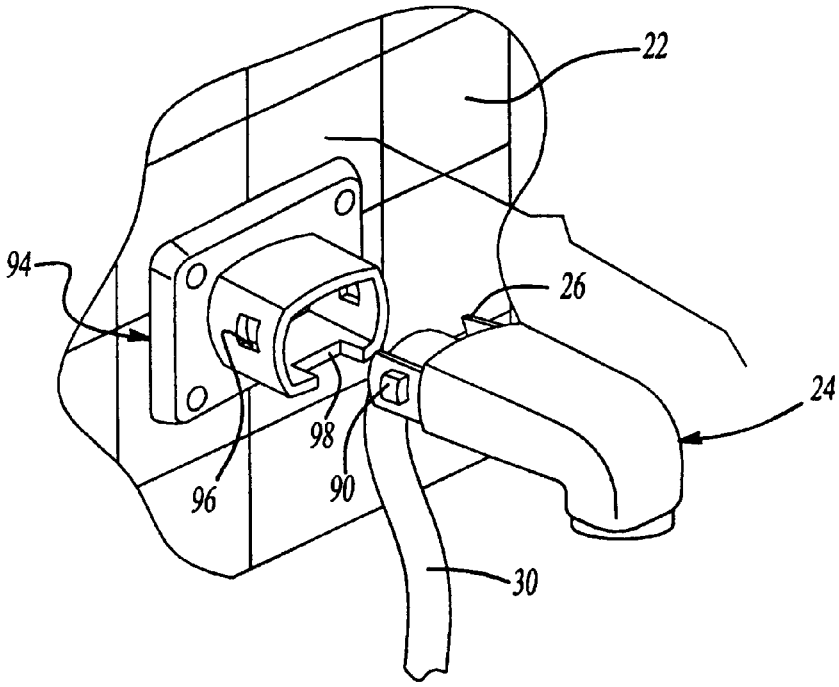
FIG. 6 illustrates an optional second mounting bracket in configurations where a showerhead is not present.

The alternate embodiment can also add an optional second stationary base when a showerhead is not present at a predetermined level such as normally found for a showerhead. FIGS. 6 provides an illustration of this type of base. In FIG. 6, a second base 94 is attached to wall 22 above the stationary base 20 (not shown). The extensible hose 30 and the pull-out spout unit 24 can attached to the second base 94 and function as a showerhead as desired. The second base 94 has a pair of second openings 96 to match the raised portion 90 of the flexible tabs 26 as in the stationary base 20. Additionally, the second base 94 has a cutout 98 to accommodate passage of the extensible hose 30.

The embodiments of the present invention have been disclosed for illustration. A person of ordinary skill in the art would recognize that any combination of any of the embodiments or certain modifications would come within the scope of this invention.

I claim:

1. An extensible and retractable bathtub spout comprising:

a stationary base having a housing with a hollow bore with front and rear openings, a means to attach the stationary base to a structure, a pull-out spout unit having a releasable mount to the front opening of the stationary base, a pressurized water supply, a length of extensible hose having an inner end connected to the pressurized water supply slidably passing through the hollow bore of the stationary base and an outer end attaching to the pull-out spout unit, the extensible hose in a stored position being contained behind the rear opening of the stationary base and capable of being extended outwardly a distance therefrom in an extended position, and the pull-out spout unit having a hollow bore with an inner open end and an outer open end with the inner open end receiving the outer end of the extensible hose and the outer open end having a spout to direct flow of pressurized water.

2. The extensible and retractable bathtub spout of claim 1 wherein the pull-out spout unit further comprises a shower head diverter valve and diverter controller.

3. The extensible and retractable bathtub spout of claim 1 wherein the releasable mount to the front opening of the stationary base is a flexible tab device.

4. The extensible and retractable bathtub spout of claim 1 wherein the releasable mount to the front opening of the stationary base is a threaded mount.

5. The extensible and retractable bathtub spout of claim 1 wherein the extensible hose has a means to prevent over-extension of the extensible hose.

6. The extensible and retractable bathtub spout of claim 1 wherein the pull-out spout unit further comprises a backflow preventer.

7. The extensible and retractable bathtub spout of claim 1 further comprising a second stationary base mounted at showerhead level configured to receive the pull-out spout unit in its extended position.

* * * * *